US010126053B2

(12) United States Patent
Todorov

(10) Patent No.: US 10,126,053 B2
(45) Date of Patent: Nov. 13, 2018

(54) PRECISION DUAL ANNEALING APPARATUS

(71) Applicant: International Business Machines Corporation, Armonk, NY (US)

(72) Inventor: Teodor K. Todorov, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 50 days.

(21) Appl. No.: 15/255,871

(22) Filed: Sep. 2, 2016

(65) Prior Publication Data

US 2018/0066891 A1 Mar. 8, 2018

(51) Int. Cl.

| | |
|---|---|
| ***F27B 9/04*** | (2006.01) |
| ***F27D 7/06*** | (2006.01) |
| ***F27D 9/00*** | (2006.01) |
| ***F27D 19/00*** | (2006.01) |
| ***F27B 9/06*** | (2006.01) |

(52) U.S. Cl.

CPC ..... *F27B 9/042* (2013.01); *F27B 9/062* (2013.01); *F27D 7/06* (2013.01); *F27D 9/00* (2013.01); *F27D 19/00* (2013.01); *F27D 2007/066* (2013.01); *F27D 2009/007* (2013.01); *F27D 2019/0037* (2013.01)

(58) Field of Classification Search

CPC ..... H05B 3/68; A47J 37/0611; A47J 37/0676; F24C 15/101; F24C 15/105; F24C 15/102

See application file for complete search history.

(56) References Cited

U.S. PATENT DOCUMENTS

| | | | | |
|---|---|---|---|---|
| 4,563,734 A | | 1/1986 | Mori et al. | |
| RE35,716 E | * | 1/1998 | Stapleton | B01L 7/52 165/61 |
| 6,111,225 A | * | 8/2000 | Ohkase | H01L 21/67109 118/724 |
| 6,394,797 B1 | * | 5/2002 | Sugaya | H01L 21/67103 118/724 |
| 7,410,355 B2 | * | 8/2008 | Granneman | H01L 21/324 118/725 |

(Continued)

FOREIGN PATENT DOCUMENTS

| | | |
|---|---|---|
| CN | 104795469 A | 7/2015 |
| CN | 103173823 B | 9/2015 |

OTHER PUBLICATIONS

English translation of CN104795469A by Yuan Xiangdong et al., Jul. 22, 2015.

(Continued)

*Primary Examiner* — Gregory A Wilson

(74) *Attorney, Agent, or Firm* — Vazken Alexanian; Michael J. Chang, LLC

(57) ABSTRACT

A dual annealing apparatus and use thereof for precision annealing of an article are provided. In one aspect, an annealing apparatus includes: a first heating plate opposite a second heating plate; a first cooling source associated with the first heating plate; and a second cooling source associated with the second heating plate, wherein the first heating plate and the second heating plate are independently controllable, and wherein the first cooling source and the second cooling source are independently controllable. A method for annealing an article using the annealing apparatus is also provided.

20 Claims, 7 Drawing Sheets

(56) References Cited

U.S. PATENT DOCUMENTS

| | | | | |
|---|---|---|---|---|
| 8,349,085 | B2 * | 1/2013 | Tahara | C23C 16/401 118/719 |
| 9,064,700 | B2 | 6/2015 | Wong et al. | |
| 9,157,153 | B2 | 10/2015 | Munteanu et al. | |
| 9,236,283 | B2 * | 1/2016 | Sahoda | H01L 21/67109 |
| 9,238,861 | B2 | 1/2016 | Munteanu et al. | |
| 9,788,687 | B2 * | 10/2017 | Frehn | A47J 37/0611 |
| 2014/0008352 | A1 * | 1/2014 | Uemura | H01J 37/32724 219/601 |
| 2016/0100462 | A1 * | 4/2016 | Morassut | F24C 15/2007 426/231 |

OTHER PUBLICATIONS

English translation of CN103173823B by Ren Cunsheng et al., Sep. 30, 2015.
List of IBM Patents or Applications Treated as Related.

* cited by examiner

PRECISION DUAL ANNEALING APPARATUS

FIELD OF THE INVENTION

The present invention relates to annealing techniques, and more particularly, to a dual annealing apparatus and use thereof for precision annealing of an article.

BACKGROUND OF THE INVENTION

Heating of planar articles is often carried out using hot plates. More advanced heating options are offered by dual-anneal assemblies such as the commonly known "waffle makers" or "waffling irons." These devices are however limited to providing uniform heat treatments on both sides of a planar or textured article.

Radiant heating tools for dual side anneals (such as rapid thermal annealing tools) have been described as well. The precision of these radiant heating devices is, however, limited in terms of temperature control and uniformity, especially in the case where the process produces volatile species that could condense on chamber walls obstructing both the radiant heat and the sensor readings.

Therefore, improved dual-side annealing tools which offer advanced heating and cooling control capabilities would be desirable.

SUMMARY OF THE INVENTION

The present invention provides a dual annealing apparatus and use thereof for precision annealing of an article. In one aspect of the invention, an annealing apparatus is provided. The annealing apparatus includes: a first heating plate opposite a second heating plate; a first cooling source associated with the first heating plate; and a second cooling source associated with the second heating plate, wherein the first heating plate and the second heating plate are independently controllable, and wherein the first cooling source and the second cooling source are independently controllable.

In another aspect of the invention, a method for annealing an article is provided. The method includes: providing an annealing apparatus having a first heating plate opposite a second heating plate, a first cooling source associated with the first heating plate, a second cooling source associated with the second heating plate, a first controller connecting the first heating plate to a first power source, and a second controller connecting the second heating plate to a second power source; introducing the article between the first heating plate and the second heating plate; and annealing a first side of the article using the first heating plate and a second side of the article using the second heating plate, wherein a temperature of the first heating plate is independently controlled during the annealing using the first cooling source and the first controller, and wherein a temperature of the second heating plate is independently controlled during the annealing using the second cooling source and the second controller.

A more complete understanding of the present invention, as well as further features and advantages of the present invention, will be obtained by reference to the following detailed description and drawings.

DETAILED DESCRIPTION OF PREFERRED EMBODIMENTS

Provided herein is a precision dual side anneal apparatus for planar articles with independent control over the heating and cooling on each side. As will be described in detail below, in one exemplary embodiment, the present apparatus is configured for annealing compound semiconductor films on substrates at temperatures exceeding 500° C. For instance, according to an exemplary embodiment, the compound semiconductor films include at least one component that is volatile at the process temperatures employed, such as films containing copper (Cu), zinc (Zn), tin (Sn), and at least one of sulfur (S) and selenium (Se) (also referred to herein as "CZTS/Se" films). With CZTS/Se films, for example, the chalcogens (i.e., S and Se) as well as Sn are volatile at annealing temperatures exceeding 500° C.

Figure 1:
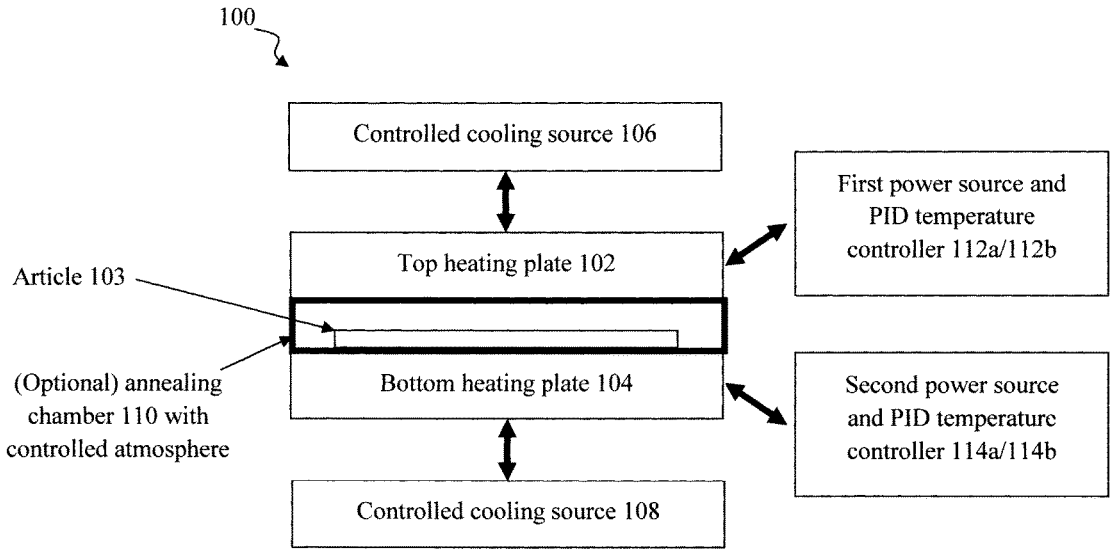
FIG. 1 is a diagram illustrating an overview of the present annealing apparatus according to an embodiment of the present invention.

An overview of the present annealing apparatus is provided in FIG. 1. As shown in FIG. 1, the present annealing apparatus 100 includes a top heating plate 102 and bottom heating plate 104 between which a (planar) article to be annealed 103 (e.g., an absorber film such as a CZTS/Se film) is placed. A (first) cooling source 106 is associated with the top heating plate 102, and a (second) cooling source 108 is associated with the bottom heating plate 104. Optionally, as shown in FIG. 1, the article 103 can be contained within an annealing chamber 110 having a controlled atmosphere.

Specifically, as shown in FIG. 1, the article 103 can be placed on the bottom heating plate 104 such that the article 103 is present between the top heating plate 102 and the bottom heating plate 104. In this manner, the top heating plate 102 and cooling source 106 will be responsible for heating and cooling (respectively) one side (e.g., in this case a top side) of the article 103, while the bottom heating plate 104 and cooling source 108 will be responsible for heating and cooling (respectively) another side (e.g., in this case a bottom side) of the article 103.

As shown in FIG. 1, the top heating plate 102 and the bottom heating plate 104 are each independently controlled via a (first) power source 112*a* and proportional-integral-derivative (PID) controller 112*b* and a (second) power source 114*a* and PID controller 114*b*, respectively. A PID controller employs a control loop feedback mechanism that, in this case, controls the power supply (from the power source) to the heating plates 102/104 to minimize an error value between a desired temperature set point and a measured value. See, for example, U.S. Pat. No. 4,563,734 by Mori et al., entitled "Multivariable Proportional-Integral-Derivative Process Control Apparatus," the contents of which are incorporated by reference as if fully set forth herein. The PID controller connects the power source to the respective heating plate and controls how much power is provided from the power source to the heating plate to control heating. Further, cooling source 106 and cooling source 108 are each independently controlled. Thus, according to the present techniques, one can precisely control the heating/cooling occurring on one side of the article 103 independently of the heating/cooling occurring on the other side of the article 103. This is a capability not available in conventional annealing tools.

Figure 2:
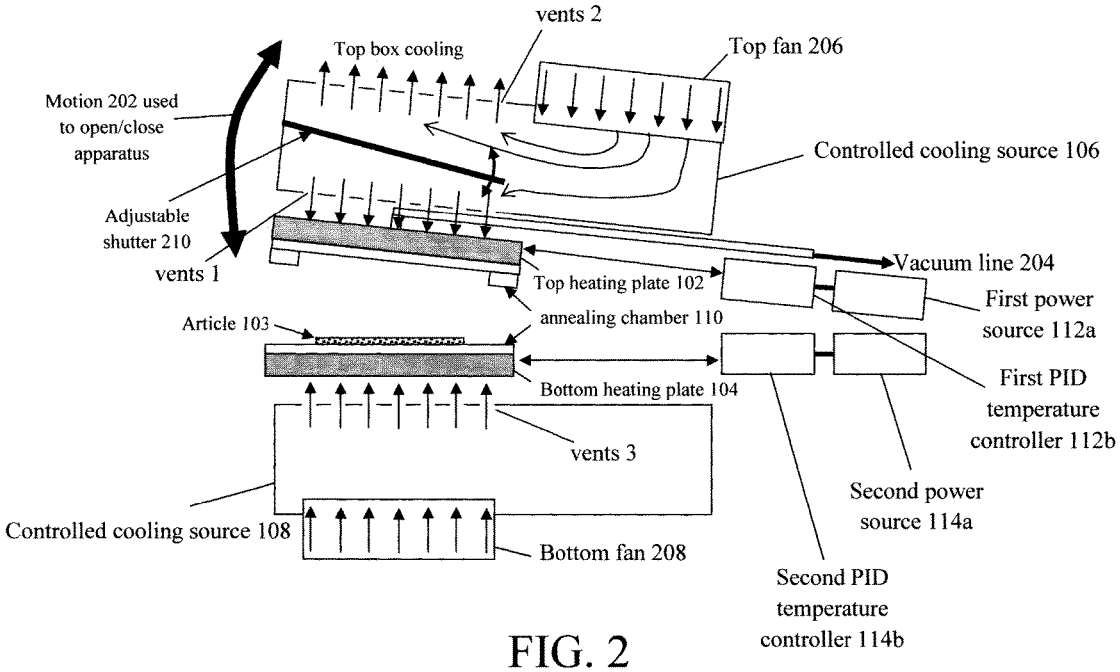
FIG. 2 is a diagram illustrating an exemplary configuration of the annealing apparatus of FIG. 1 which employs air cooling according to an embodiment of the present invention.

One exemplary configuration of the annealing apparatus 100 is shown in FIG. 2. In this example, the annealing apparatus has a waffle maker configuration wherein two halves of the apparatus open and close with a clamshell design. During operation, the (planar) article 103 (e.g., a CZTS/Se absorber film) is placed on the heating plate of one half of the apparatus. The two halves of the apparatus are then brought together (i.e., in a clamshell manner—see arrow 202) trapping the article 103 between the heating plates. For instance, as shown in FIG. 2, the article 103 is placed on the bottom heating plate 104. The top heating plate 102 and the bottom heating plate 104 are then brought together (see arrow 202) to trap the article 103 between the heating plates 102 and 104. According to an exemplary embodiment, the top heating plate 102 and the bottom heating plate 104 are graphite and/or copper hot plates. An advantage of a copper heat plate is that it provides greater thermal uniformity.

As shown in FIG. 2, an annealing chamber 110 is affixed to the heating plates such that, when the heating plates are brought together, the article 103 is enclosed in a controllable atmosphere. Specifically, one (first) half of the annealing chamber 110 is affixed to the top heating plate 102 and another (second) half of the annealing chamber 110 is affixed to the bottom heating plate 104. When the top heating plate 102 and the bottom heating plate 104 are brought together, the two halves of the annealing chamber 110 combine to form an airtight enclosure. In this case, prior to closing the device, the article 103 is placed on the half of the annealing chamber on the bottom heating plate 104. Thus, when the top heating plate 102 and the bottom heating plate 104 are brought together, the article 103 is encased in the (sealed) annealing chamber 110 (as shown in FIG. 1). According to an exemplary embodiment, the annealing chamber is formed from quartz plates.

The atmosphere within the annealing chamber is controllable. For example, as shown in FIG. 2, a vacuum line 204 can be implemented to create a vacuum within the annealing chamber 110.

As described above, the top heating plate 102 and the bottom heating plate 104 are each independently controllable via a (first) power source 112*a* and PID controller 112*b* and a (second) power source 114*a* and PID controller 114*b*, respectively. According to an exemplary embodiment, the top heating plate 102 and the bottom heating plate 104 can each be independently heated to temperatures up to about 650° C., with a precision of ±2° C.

To control cooling, an (independently controllable) cooling source 106 is associated with top heating plate 102 0-and an (independently controllable) cooling source 108 is associated with bottom heating plate 104. In this example, an air cooling mechanism will be employed to control the rate of cooling. For instance, the article 103 will be heated via (independently controlled) top heating plate 102 and bottom heating plate 104 to a given temperature(s) (i.e., the top and bottom sides of the article 103 can be heated to different temperatures using the apparatus), and then cooled. The rate of cooling of the top and bottom sides of the article 103 are (independently) controlled via the cooling source 106 and the cooling source 108, respectively. In this particular example, cooling source 106 is a box-shaped enclosure (adjacent to the first heating plate 102) that includes a (top/first) fan 206 and cooling source 108 is another box-shaped enclosure (adjacent to the second heating plate 104) that includes a (bottom/second) fan 208.

As shown in FIG. 2, air from fan 206 is directed by an adjustable shutter 210 towards a first set of vents (labeled "vents 1") in a side of the enclosure adjacent to and facing the top heating plate 102 and/or towards a second set of vents (labeled "vents 2") in a side of the enclosure at a top of the cooling source 106 (and thus facing away from the top heating plate 102. Air exiting the first set of vents serves to cool the top heating plate 102. Accordingly, the greater the amount of air being diverted (via shutter 210) to the first set of vents, the greater the rate of cooling at the top heating plate 102, and vice-versa. Air from fan 206 not diverted to the first set of vents exits the cooling source 106 via the second set of vents. According to an exemplary embodiment, the fan 206 is always kept on during operation of the apparatus, and the cooling airflow from fan 206 is regulated via the shutter 210. Specifically, there is more of a need for constant cooling of the top assembly than for the bottom because the convective flow from the heater goes straight to it. So the top fan is needed and instead of having a second top fan for cooling the heater, the flow to the heater is controlled via the shutter 210. Since the shutter 210 manipulates the path of the airflow from fan 206, the location of fan 206 in cooling source 106 can be offset from the vents (e.g., as shown in FIG. 2, the fan 206 is located at one side of the cooling source 106, while the first and second vents are located at another side of the cooling source. By comparison, when the fan itself is regulated (by turning the fan on only when needed) and no shutter is used, then it is preferable to locate the fan opposite the vent in the cooling source. See, for example, cooling source 108.

Air from fan 208 exits through a set of vents (labeled "vents 3") in a side of the enclosure adjacent to and facing the bottom heating plate 104 and serves to cool the bottom heating plate 104. In the exemplary embodiment shown in FIG. 2, the fan 208 is turned on, when needed, and then back off. Thus, when the fan 208 is turned on (e.g., following annealing) cooling at the bottom heating plate 104 will occur.

Following a heating/cooling treatment, the top heating plate 102 and the bottom heating plate 104 can be moved apart (via the clamshell design), and the annealed article 103 removed from the apparatus. When the annealing chamber is present, the two halves of the annealing chamber 110 separate when the top heating plate 102 and the bottom heating plate 104 are separated. See FIG. 2. Thus access can be gained to the annealed article 103 in the annealing chamber 110.

Figure 3:
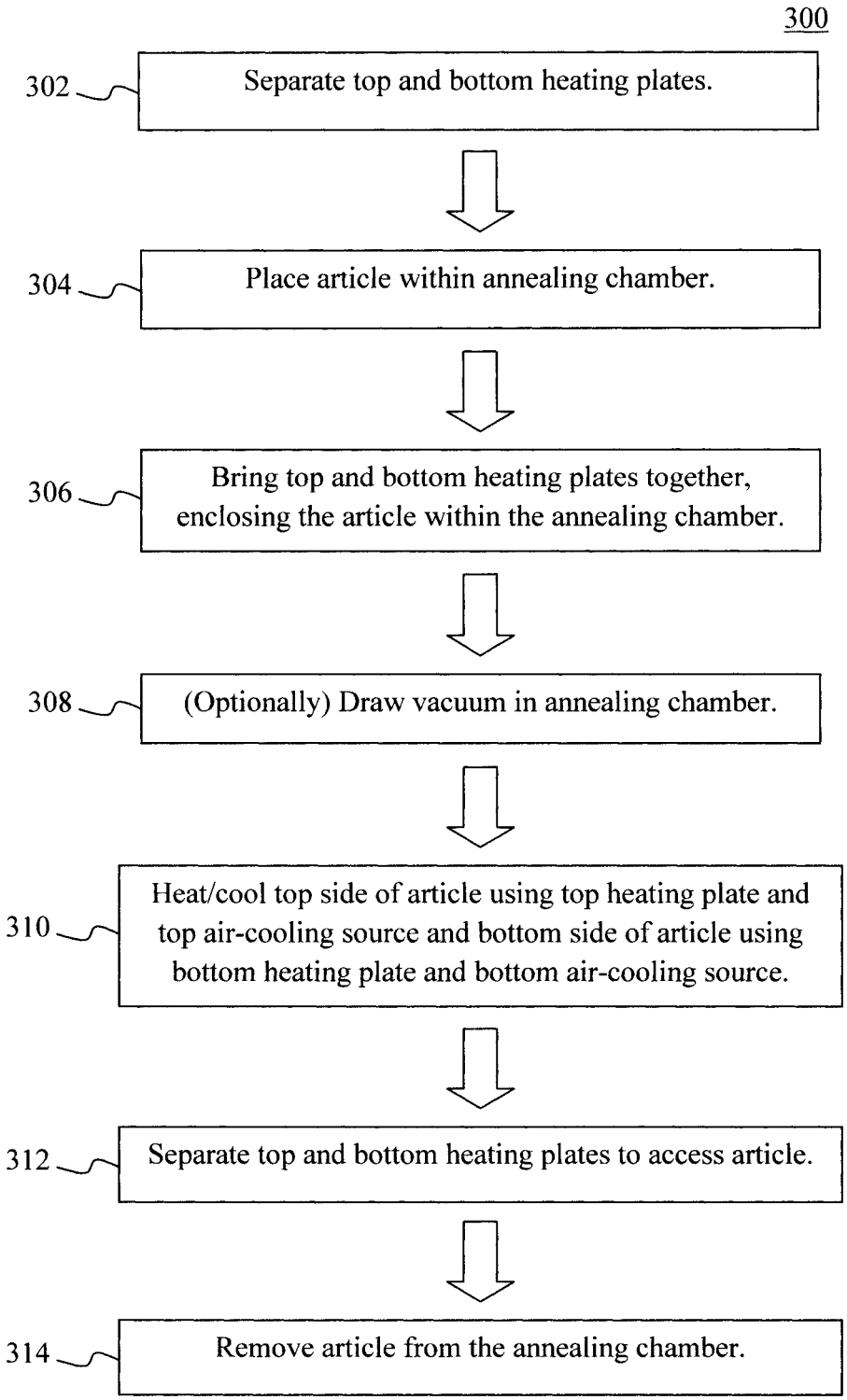
FIG. 3 is a diagram illustrating an exemplary methodology for annealing an article using the annealing apparatus of FIG. 2 according to an embodiment of the present invention.

FIG. 3 illustrates an exemplary methodology 300 for annealing a (e.g., planar) article 103 using the (air-cooled) version of the annealing apparatus 100 shown in FIG. 2. Being a planar article, reference will be made to a top surface and a bottom surface of article 103. By way of example only, article 103 is a CZTS/Se absorber film.

Independently controllable top and bottom heating can be advantageous to minimize loss of volatile components of a CZTS/Se film during annealing. See, for example, U.S. patent application Ser. No. 15/255,929, entitled "Minimizing Tin Loss During Thermal Processing of Kesterite Films," the contents of which are incorporated by reference as if fully set forth herein. Further, in this example, an annealing chamber is present between the heating plates. However, devices are contemplated herein which do not include an atmosphere controlled annealing chamber, which function in the same manner as now described.

In step 302, the top heating plate 102 and the bottom heating plate 104 are separated which, according to the present exemplary embodiment, separates the two halves of the annealing chamber 110 attached to the top heating plate 102 and the bottom heating plate 104. In step 304, the article is placed within the annealing chamber and, in step 306, the top heating plate 102 and the bottom heating plate 104 are brought together—enclosing the article 103 within the annealing chamber 110.

Optionally, in step 308, a vacuum is drawn in the annealing chamber, e.g., via vacuum line 204. Then in step 310, a first side (e.g., a top side) of the article 103 is heated/cooled via top heating plate 102 and a second side (e.g., a bottom side) of the article 103 is heated/cooled via bottom heating plate 104. During the heating step 310, the temperatures of the top heating plate 102 and the bottom heating plate 104 are independently controlled using the first power source 112*a* and PID temperature controller 112*b*/cooling source 106 and the second power source 114*a* and PID temperature controller 114*b*/cooling source 108, respectively.

For instance, annealing of the top side of the article 103 can be carried out by increasing the power to the top heating plate 102 (via the first power source 112*a* and PID temperature controller 112*b*) and diverting air from top fan 206 away from the first set of vents. To then cool down the top side of the article 103, the power to the top heating plate 102 can be decreased (via the first power source 112*a* and PID temperature controller 112*b*) and air from top fan 206 can be diverted towards the vents 1 so as to cool the top heating plate 102.

Independently and simultaneously with the top heating plate 102, annealing of the bottom side of the article 103 can be carried out by increasing the power to the bottom heating plate 104 (via the second power source 114*a* and PID temperature controller 114*b*) and keeping the bottom fan 208 switched off. To then cool down the bottom side of the article 103, the power to the bottom heating plate 104 can be decreased (via the second power source 114*a* and PID temperature controller 114*b*) and the bottom fan 208 can be switched on such that air produced therefrom can pass through the vents 3 and cool the bottom heating plate 104.

Following the heating and cooling cycle, in step 312 the top heating plate 102 and the bottom heating plate 104 are separated providing access to the annealed article 103. In step 314, the annealed article 103 is removed from the annealing chamber 110.

Another version of the annealing apparatus 100 is now described that employs water cooling as opposed to air-based cooling. As will be described in detail below, a water-cooled heat sink will serve as what is referred to herein as a "cooling brake." Namely, when the water-cooled heat sink is brought into contact with the heating plate(s) (again the top and bottom side heating and cooling can be independently controlled), the heating is immediately halted and a cool down begins. The rate of cooling can be controlled either via the contacting time and pressure of the brake or by simultaneously powering the heater to slow down the cooling.

Figure 4:
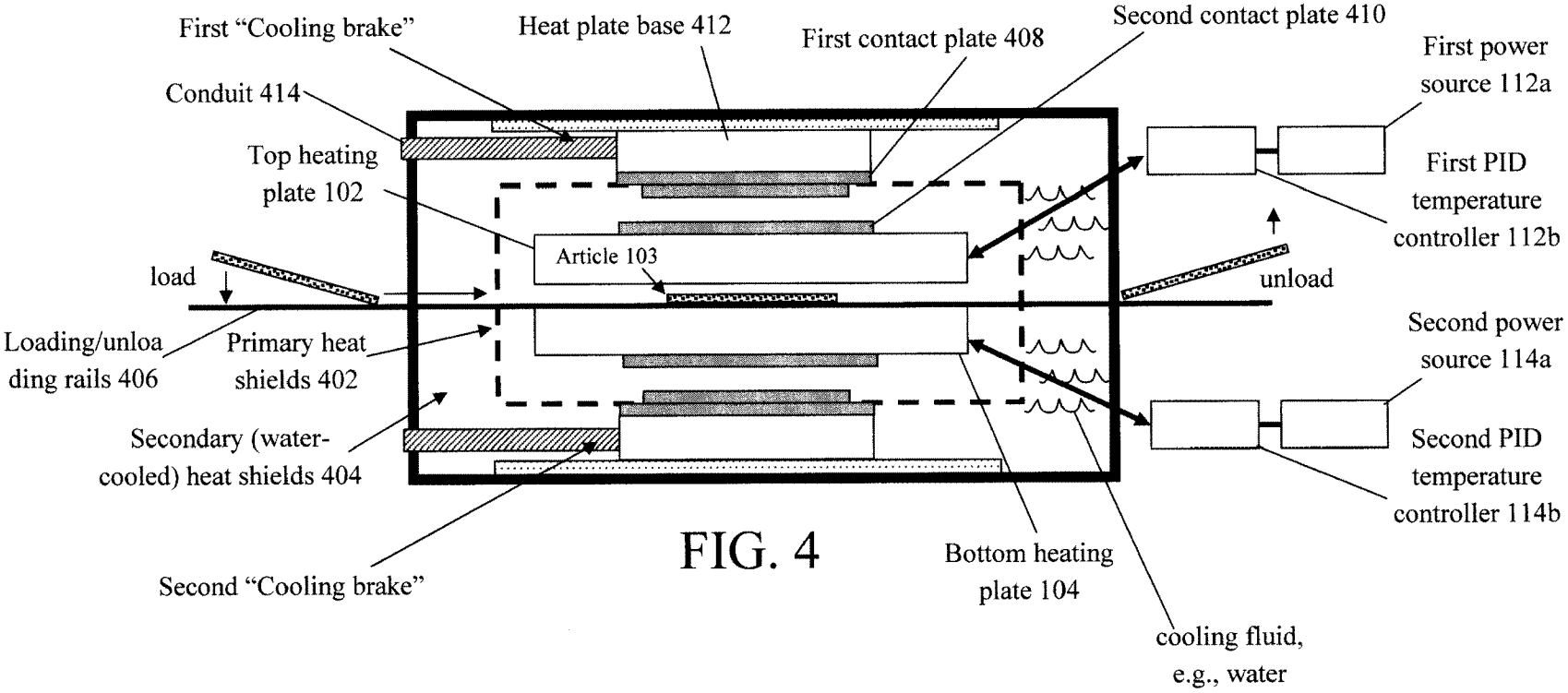
FIG. 4 is a diagram illustrating an exemplary configuration of the annealing apparatus of FIG. 1 which employs a water-cooled heat sink as a cooling brake according to an embodiment of the present invention.

Reference is now made to FIG. 4 which illustrates another version of the annealing apparatus 100 having a cooling brake. Unlike the clamshell-based embodiment above, here a slot is provided for introducing an article into the annealing apparatus between the top heating plate 102 and the bottom heating plate 104. To engage the cooling brake, a water-cooled heat sink is placed in contact with the respective heating plate to immediately initiate cooling (see, for example, FIG. 5—described below).

Specifically, as shown in FIG. 4, the top heating plate 102 and the bottom heating plate 104 are located opposite one another with a space therebetween in which the article 103 is introduced. In the exemplary embodiment shown illustrated in FIG. 4, the article 103 is introduced between the top heating plate 102 and the bottom heating plate 104 via in-line loading and unloading rails 406. According to an exemplary embodiment, the top heating plate 102 and the bottom heating plate 104 are graphite and/or copper hot plates. An advantage of a copper heat plate is that it provides greater thermal uniformity.

As above, the top heating plate 102 and the bottom heating plate 104 are each independently controllable via a (first) power source 112*a* and PID controller 112*b* and a (second) power source 114*a* and PID controller 114*b*, respectively. According to an exemplary embodiment, the top heating plate 102 and the bottom heating plate 104 can each be independently heated to temperatures up to about 650° C., with a precision of +2° C.

As shown in FIG. 4, articles 103 can be loaded on the rails 406 outside of the annealing device and then slid (in this example from left to right) along the rails 406 in between the top heating plate 102 and the bottom heating plate 104. Advantageously, the rails 406 serve to center the article 103 between the heating plates 102 and 104. Motion of the articles 103 (i.e., along rails 406) can be automated, such as via a motorized conveyor belt system, or manual where the articles 103 are advanced along the rails 406 by action of the user, or some combination thereof. For instance, a conveyor belt system can be employed that is controllable either by a motor and/or by a user. See, for example FIG. 4A.

Figure 4A:
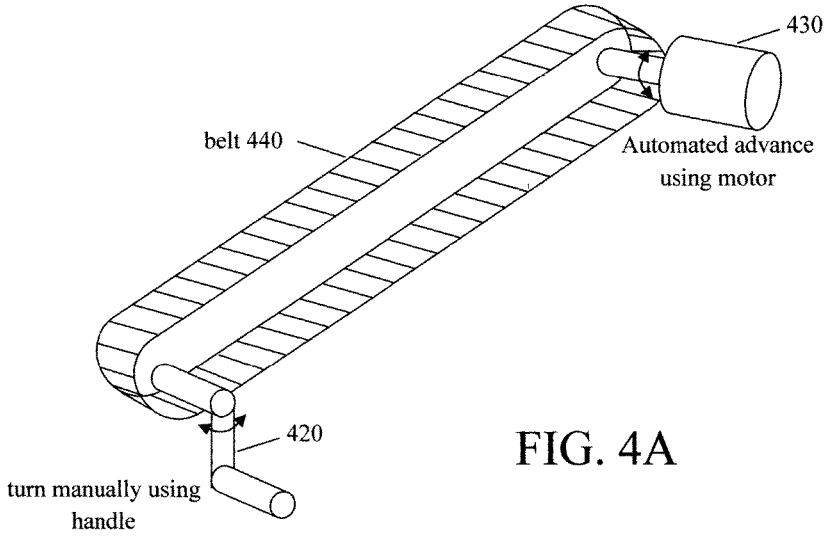
FIG. 4A is a diagram illustrating an exemplary conveyor belt system for moving articles into and out of the apparatus according to an embodiment of the present invention.

Referring briefly to FIG. 4A, rails 406 can include a (e.g., metal) belt 440 that conveys the articles 103 through the annealing apparatus 100. The belt 440 can be actuated manually by turning a handle 420 and/or in an automated manner using a motor 430. The speed at which the belt 440 is turned can be controlled to coincide with the annealing/cooling time for a given application, i.e., to regulate how long each of the articles 103 remains between the top heating plate 102 and the bottom heating plate 104. Further, the belt 440 can be operated in a stop and go manner, whereby the belt 440 is advanced to place the article 103 between the top heating plate 102 and the bottom heating plate 104 and then stopped. Once the proper annealing/cooling duration has elapsed, then the belt is again advanced to place the next article 103 between the top heating plate 102 and the bottom heating plate 104 (and permits the previously annealed article to be removed from the apparatus), and so on.

Referring back to FIG. 4, the top heating plate 102 and the bottom heating plate 104 are encased in a primary heat shield 402. According to an exemplary embodiment, primary heat shield 402 is a metal heat shield. Suitable heat shield metals include, but are not limited to, stainless steel and/or aluminum.

While shown illustrated using dotted lines, the primary heat shield 402 is preferably a solid/continuous structure encasing the top heating plate 102 and the bottom heating plate 104. For instance, a secondary heat shield 404 is present surrounding the primary heat shield 402 and, in the example shown in FIG. 4, the secondary heat shield 404 is a water-cooled heat shield. Namely, the secondary heat shield 404 includes a metal heat shield encasing the primary heat shield 402, and wherein a cooling fluid (such as water) is circulated in the space between the primary heat shield 402 and the secondary heat shield 404. According to an exemplary embodiment, secondary heat shield 404 is a metal (e.g., stainless steel and/or aluminum) heat shield.

A cooling brake assembly is preferably included adjacent to each of the top heating plate 102 and the bottom heating plate 104. See FIG. 4. By including separate cooling brakes for the top and bottom heating plates, the heating and cooling of the (top and bottom) sides of the article 103 can be independently controlled. For instance, during operation when cooling is needed on a given side of the article 103, the cooling brake is brought in contact with the respective heating plate. For example, bringing the first cooling brake in contact with the top heating plate 102 will initiate cooling at the top heating plate 102/top side of article 103, and/or bringing the second cooling brake in contact with the bottom heating plate 104 will initiate cooling at the bottom heating plate 104/bottom side of article 103. According to an exemplary embodiment, each cooling brake includes a (first) metal contact plate 408 and each heating plate 102/104 includes a (second) metal contact plate 410 that, when brought together, establish thermal contact between the cooling brake and the respective heating plate 102/104. Suitable metals for the contact plates 408/410 include, but are not limited to, graphite and/or copper.

As shown in FIG. 4, each cooling brake further includes a heat plate base 412 through which a conduit 414 circulates a cooling fluid (e.g., water). See, for example, FIG. 6. In the example shown illustrated in FIG. 6, the heating plate (specifically the bottom heating plate 104 in this example) and the cooling brake (specifically the second cooling brake in this example) have a circular configuration. This is however merely an example, and any shape (square, rectangular, etc.) is suitable for the present annealing apparatus. According to an exemplary embodiment, the top heating plate 102/first cooling brake and the bottom heating plate 104/second cooling brake have the same configuration as one another. Thus, what is shown in FIG. 6 would be the same for the top heating plate 102/first cooling brake, except that the structures would be inverted with the cooling brake on top (see for example FIG. 4).

Figure 6:
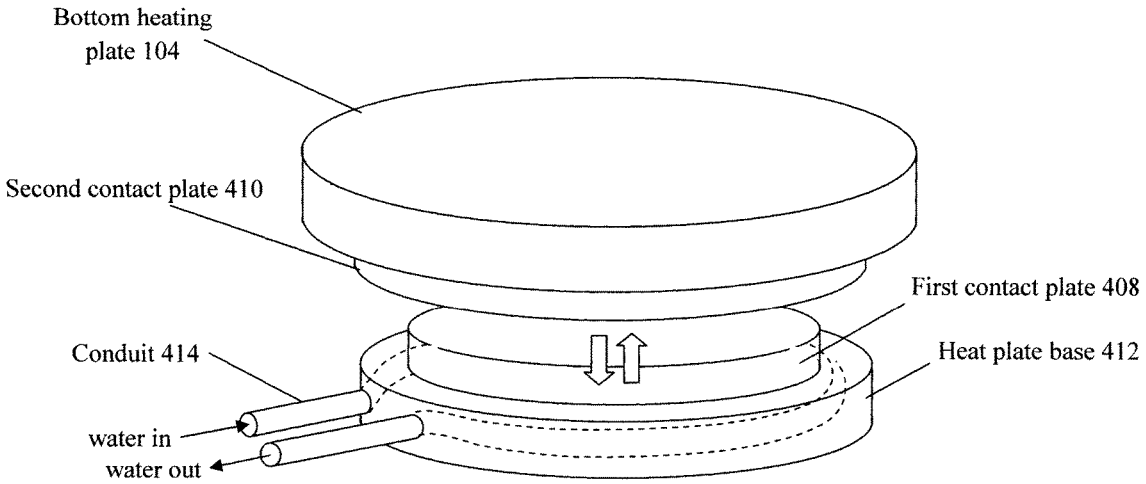
FIG. 6 is a diagram illustrating an exemplary cooling brake configuration according to an embodiment of the present invention.

As shown in FIG. 6, the second cooling brake consists of a heat plate base 412 through which a conduit 414 circulates a cooling fluid (e.g., water) to thereby cool the heat plate base 412. A first contact plate 408 is present on the heat plate base 412. A second contact plate 410 is present on (the bottom side of) the bottom heat plate 104 (aligned with the first contact plate 408). When cooling is initiated, the cooling brake is actuated up to the bottom heating plate 104 such that the first contact plate 408 makes contact with the second plate 410. Heat from the bottom heating plate 104 will then pass through the contact plates 408/410 to the heat plate base 412.

Figure 5:
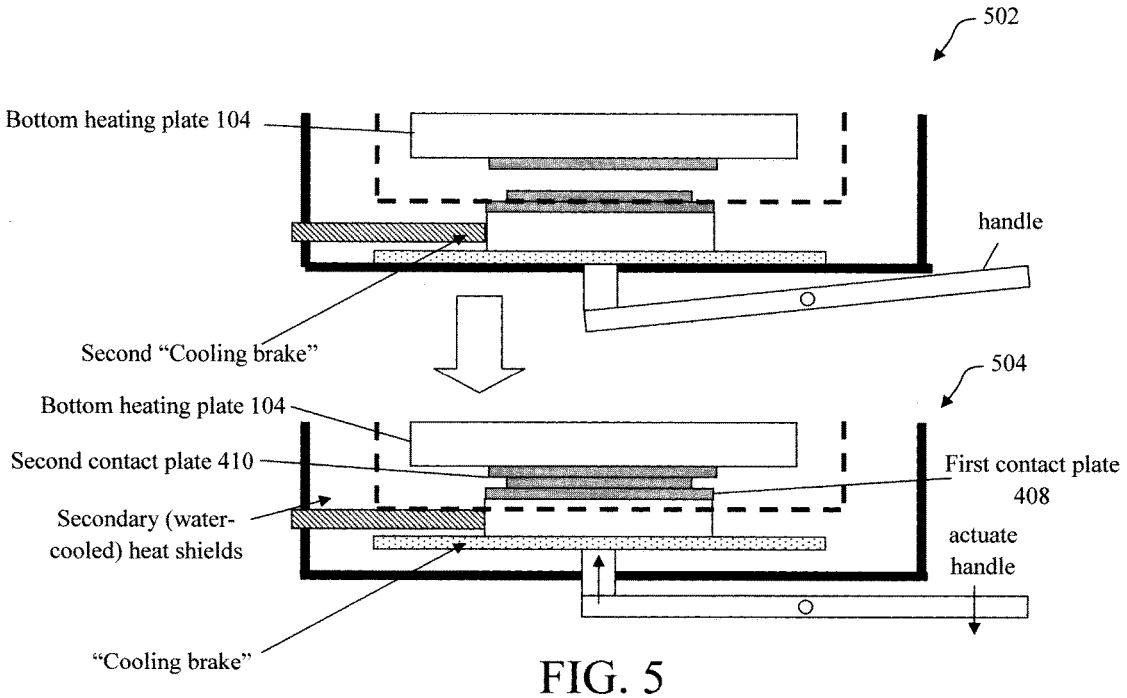
FIG. 5 is a diagram illustrating action of the cooling brakes according to an embodiment of the present invention.

FIG. 5 is a diagram illustrating action of the cooling brake with respect to the bottom heating plate 104 and second cooling brake. However, the same action applies to the top heating plate 102 and first cooling brake. As shown in step 502 of FIG. 5, the cooling brake is lowered (or raised in the case of the top heating plate 102 and first cooling brake) and in a non-contact position with the bottom heating plate 104. This configuration may be employed, e.g., while heating via the bottom heating plate 104 is occurring. A handle is used in this example to actuate the cooling brake, bringing the cooling brake towards or away from the bottom heating plate 104. However, any suitable mechanism may be employed to actuate the cooling brakes.

As shown in step 504, to initiate cooling, the cooling brake is brought towards the bottom heating plate 104 such that the first contact plate 408 (of the cooling brake) is brought in contact with the second contact plate 410 (of the bottom heating plate 104). In the example shown, this is accomplished using the handle.

Figure 7:
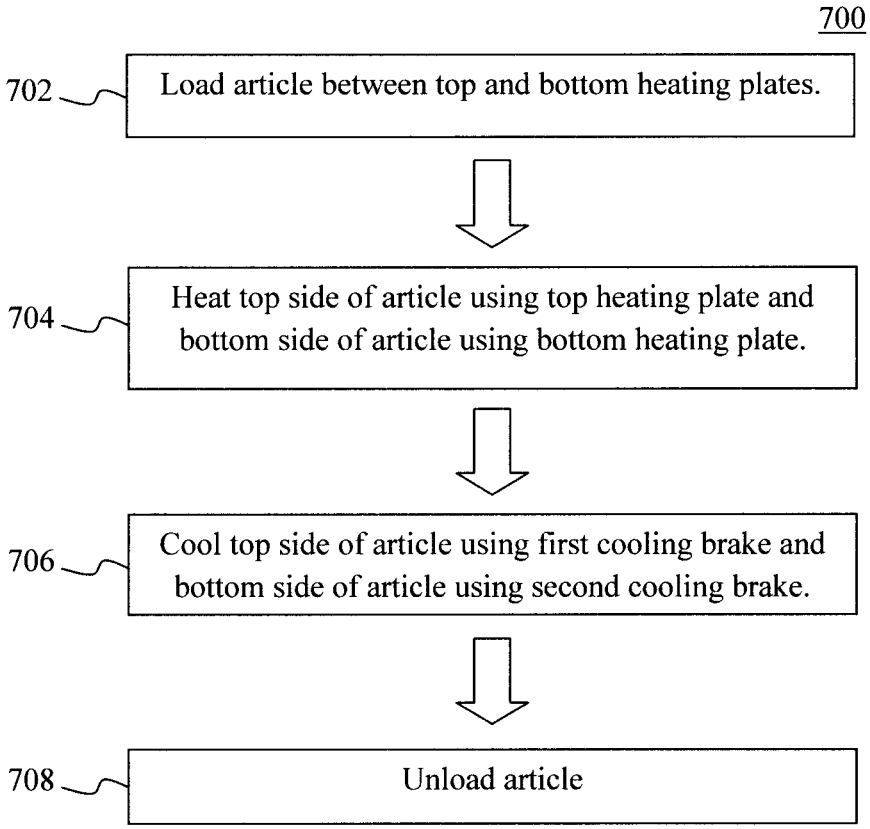
FIG. 7 is a diagram illustrating an exemplary methodology for annealing an article using the annealing apparatus of FIG. 4 according to an embodiment of the present invention.

FIG. 7 illustrates an exemplary methodology 700 for annealing a (e.g., planar) article 103 using the (water-cooled, cooling brake) version of the annealing apparatus 100 shown in FIG. 4. By way of example only, article 103 is a CZTS/Se absorber film.

In step 702, the article 103 is placed between the top heating plate 102 and the bottom heating plate 104. By way of example only, the loading/unloading rails 406 may be employed to introduce the article 103 between the top heating plate 102 and the bottom heating plate 104.

Then in step 704, a first side (e.g., a top side) of the article 103 is heated via top heating plate 102 and, independently, a second side (e.g., a bottom side) of the article 103 is heated via bottom heating plate 104. During the heating step 704, the temperature of the top heating plate 102 and the bottom heating plate 104 are independently controlled using the first power source 112*a* and PID temperature controller 112*b*/cooling source 106 and the second power source 114*a* and PID temperature controller 114*b*/cooling source 108, respectively.

Following heating, in step 706 the first side (e.g., a top side) of the article 103 is cooled via the first cooling brake and, independently, the second side (e.g., a bottom side) of the article 103 is cooled via the second cooling brake. As described above, cooling is initiated by moving the cooling brake towards the respective heating plate, such that the first contact plate 408 (on the cooling brake) makes contact with the second contact plate 410 (on the heating plate).

Thus, like with the heating via the heating plates, the cooling via the cooling brakes is independently controllable. Namely, one cooling brake can be brought in contact with the heating plate independently of the other. Thus, cooling of one side of the article 103 can be carried out independently of the other, at different times, different intervals, etc.

Following the heating and cooling cycle, in step 708 the article 103 is removed from between the top heating plate 102 and the bottom heating plate 104. By way of example only, the loading/unloading rails 406 may be employed to unload the article 103 from the apparatus 100.

Although illustrative embodiments of the present invention have been described herein, it is to be understood that the invention is not limited to those precise embodiments, and that various other changes and modifications may be made by one skilled in the art without departing from the scope of the invention.

What is claimed is:

1. An annealing apparatus, comprising:

a first heating plate opposite a second heating plate;

an annealing chamber in between the first heating plate and the second heating plate;

a first cooling source associated with the first heating plate; and a second cooling source associated with the second heating plate, wherein the first heating plate and the second heating plate are independently controllable, and wherein the first cooling source and the second cooling source are independently controllable.

2. The annealing apparatus of claim 1, wherein the first heating plate and the second heating plate are each formed of a metal selected from the group consisting of: graphite, copper, and combinations thereof.

3. The annealing apparatus of claim 1, further comprising:

a first power source; and a first controller connecting the first heating plate to the first power source.

4. The annealing apparatus of claim 3, further comprising:

a second power source; and a second controller connecting the second heating plate to the second power source.

5. The annealing apparatus of claim 4, wherein the first controller and the second controller each comprises a proportional-integral-derivative (PID) controller.

6. The annealing apparatus of claim 1, wherein the annealing chamber comprises a quartz chamber.

7. The annealing apparatus of claim 1, wherein the annealing chamber comprises a first half and a second half which when combined form an airtight enclosure.

8. The annealing apparatus of claim 1, wherein the first half of the annealing chamber is attached to the first heating plate, and wherein the second half of the annealing chamber is attached to the second heating plate.

9. The annealing apparatus of claim 1, wherein the first cooling source comprises:

a first enclosure, adjacent to the first heating plate, containing a first fan; and a first set of vents in a side of the first enclosure facing the first heating plate.

10. The annealing apparatus of claim 9, wherein the first cooling source comprises:

a second set of vents in a side of the first enclosure facing away from the first heating plate.

11. The annealing apparatus of claim 9, wherein the first cooling source further comprises:

an adjustable shutter configured to divert air from the first fan toward either the first set of vents or the second set of vents.

12. The annealing apparatus of claim 9, wherein the second cooling source comprises:

a second enclosure, adjacent to the second heating plate, containing a second fan; and a third set of vents in a side of the second enclosure facing the second heating plate.

13. The annealing apparatus of claim 1, further comprising:

rails for introducing an article between the first heating plate and the second heating plate.

14. The annealing apparatus of claim 1, wherein the first cooling source comprises:

a first water-cooled heat sink that is positionable to be either i) in a contact position with the first heating plate, or ii) in a non-contact position with the first heating plate.

15. The annealing apparatus of claim 14, wherein the second cooling source comprises:

a second water-cooled heat sink that is positionable to be either i) in a contact position with the second heating plate, or ii) in a non-contact position with the second heating plate.

16. The annealing apparatus of claim 15, wherein the first water-cooled heat sink and the second water-cooled heat sink each comprises:

a heat plate base;

a conduit configured to circulate water through the heat plate base; and a first contact plate on the heat plate base.

17. The annealing apparatus of claim 16, further comprising:

a second contact plate on each of the first heating plate and the second heating plate, wherein the second contact plate is aligned with the first contact plate.

18. A method for annealing an article, comprising:

providing an annealing apparatus having a first heating plate opposite a second heating plate, a first cooling source associated with the first heating plate, a second cooling source associated with the second heating plate, a first controller connecting the first heating plate to a first power source, and a second controller connecting the second heating plate to a second power source;

introducing the article between the first heating plate and the second heating plate; and annealing a first side of the article using the first heating plate and a second side of the article using the second heating plate, wherein a temperature of the first heating plate is independently controlled during the annealing using the first cooling source and the first controller, and wherein a temperature of the second heating plate is independently controlled during the annealing using the second cooling source and the second controller, and wherein the annealing apparatus further comprises an annealing chamber in between the first heating plate and the second heating plate, the method further comprising:

drawing a vacuum in the annealing chamber.

19. The method of claim 18, wherein the first cooling source includes a first enclosure, adjacent to the first heating plate, containing a first fan, and wherein the second cooling source comprises a second enclosure, adjacent to the second heating plate, containing a second fan, the method further comprising:

independently cooling the first heating plate using the first fan; and independently cooling the second heating plate using the second fan.

20. The method of claim 18, wherein the first cooling source includes a first water-cooled heat sink with an adjustable position, and wherein the second cooling source includes a second water-cooled heat sink with an adjustable position, the method further comprising:

independently cooling the first heating plate by adjusting the position of the first water-cooled heat sink such that the first water-cooled heat sink is in a contact position with the first heating plate; and independently cooling the second heating plate by adjusting the position of the second water-cooled heat sink such that the second water-cooled heat sink is in a contact position with the second heating plate.

* * * * *